US006955413B2

(12) United States Patent
Kohno et al.

(10) Patent No.: US 6,955,413 B2
(45) Date of Patent: Oct. 18, 2005

(54) PRINTING APPARATUS AND METHOD FOR PRINTING AN IMAGE

(75) Inventors: Tetsushi Kohno, Tokyo (JP); Masaya Kikuta, Kanagawa (JP); Norio Shimura, Kanagawa (JP); Takeaki Nakano, Tokyo (JP); Hirokazu Kameda, Kanagawa (JP); Masaaki Endo, Tokyo (JP); Shigeki Abe, Tokyo (JP); Manabu Kuchiki, Kanagawa (JP); Masanori Echigo, Kanagawa (JP); Munetaka Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/648,917

(22) Filed: Aug. 27, 2003

(65) Prior Publication Data

US 2004/0041870 A1 Mar. 4, 2004

(30) Foreign Application Priority Data

Aug. 28, 2002 (JP) ..... 2002-249706

(51) Int. Cl.[7] ..... B41J 29/393; B41J 2/01
(52) U.S. Cl. ..... 347/19; 347/101
(58) Field of Search ..... 347/19, 16, 101; 346/134, 139 A; 400/496, 578

(56) References Cited

U.S. PATENT DOCUMENTS 6,669,331 B2 * 12/2003 Teshigawara et al. ..... 347/43
6,747,429 B2 * 6/2004 Igarashi ..... 318/560

FOREIGN PATENT DOCUMENTS

JP 10-58801 3/1998

* cited by examiner

*Primary Examiner*—Thinh Nguyen
(74) *Attorney, Agent, or Firm*—Morgan & Finnegan LLP

(57) ABSTRACT

A printing apparatus of the invention acquires a velocity and an acceleration of a printing medium when a rear end of the printing medium passes through a detection lever. A correction amount for the rear end of the printing medium is determined in accordance with the velocity and the acceleration of the printing medium. The correction amount is a transportation amount of the printing medium during a physical return time after the rear end of the printing medium passes through the detection lever until the detection lever is detected by a sensor. A remaining region from a printing position of a print head up to the rear end of the printing medium is controlled in accordance with the correction amount for the rear end of printing medium.

10 Claims, 8 Drawing Sheets

PRINTING APPARATUS AND METHOD FOR PRINTING AN IMAGE

This application claims priority from Japanese Patent Application No. 2002-249706 filed Aug. 28, 2002, which is incorporated hereinto by reference.

BACKGROUND OF THE INVENTION

1. Field of the Invention

The present invention relates to a printing apparatus such as an inkjet printer and a method for printing an image.

2. Description of the Related Art

Conventional printing apparatus such as a serial inkjet printer includes those which detect a rear end of a printing medium and print an image in a remaining region from a printing position of a print head up to the rear end of the printing medium after detecting the rear end. Specifically, when the printing apparatus of this type detects the rear end of the printing medium, in order to use only print data corresponding to the remaining region from the printing position of the print head up to the rear end of the printing medium, print data in the excess of the remaining region is discarded. In general, the printing apparatus of this type includes a swing-type detection lever for the printing medium and an optical sensor for detecting the operation of the detection lever as means for detecting the rear end of the printing medium.

In such a printing apparatus, the detection lever is provided on a transport path for the printing medium and upstream of the print head at a predetermined distance from the same. The detection lever starts swinging when it is put in contact with a front end of the printing medium being transported and returns to an initial position (standby position) when the rear end of the printing medium passes through the same. The sensor detects the detection lever of that returns to the standby position after the rear end of the printing medium passes therethrough and outputs a signal indicating that the rear end of the printing medium has been detected.

In such a mechanical detecting means for the printing medium, a certain delay associated with the swing of the detection lever occurs when the rear end of the printing medium is detected regardless of the velocity at which the printing medium is transported. Therefore, the remaining region of the printing medium as described above has been corrected by a constant value according to the delay associated with the detection lever.

In printing apparatus as described above, it is becoming common to increase the transportation velocity of the printing medium when a marginal space of the printing medium is forwarded in order to improve throughput. When the transportation velocity of the printing medium is thus changed during a series of printing operations, the remaining region as described above also changes in accordance with the velocity of the printing medium transportation. For the purpose of controlling the remaining region of the printing medium accurately, it is therefore insufficient to correct the remaining region of the printing medium using only the constant value according to the delay attributable to the detection lever.

The printing apparatus disclosed in Japanese Patent Application Laid-open No. 10-058801 (1998) is known as a technique taking such a change in the transportation velocity of the printing medium into consideration. In the printing apparatus disclosed in the publication, the remaining region from a printing position of a print head up to a rear end of a printing medium is controlled in accordance with the velocity at which the printing medium is transported. Specifically, in the printing apparatus, a length D of the remaining region for a low transportation velocity is stored in advance, and the length D of the remaining region is corrected by a predetermined value $\alpha$ to set the length of the remaining region as $(D-\alpha)$ when the velocity of the printing medium transportation increases beyond the low transportation velocity.

However, the printing apparatus disclosed in Japanese Patent Application Laid-open No. 10-058801 (1998) merely corrects the length of the remaining region by the constant value $\alpha$ in accordance with the velocity of the printing medium transportation, although the change in the transportation velocity of the printing medium is taken into consideration to some degree indeed. Therefore, the technique disclosed in the publication does not sufficiently mitigate problems such as a positional shift of an image and ejection of ink on to objects other than the printing medium such as a platen.

The present invention is directed to overcome one or more of the problems as set forth above.

SUMMARY OF THE INVENTION

The printing apparatus of the present invention is a printing apparatus for printing an image on a printing medium using a print head, comprising: a transporting means for transporting the printing medium in a predetermined direction; a printing medium detecting means including a detection lever that is provided upstream of the print head in the predetermined direction and that mechanically operates when a rear end of the printing medium passes therethrough and a sensor for detecting the mechanical operation of the detection lever; an acceleration acquiring means for acquiring an acceleration of the printing medium when the rear end of the printing medium passes through the detection lever; and a correcting means for correcting a transportation amount of the printing medium during a physical return time after the rear end of the printing medium passes through the detection lever until the detection lever is detected by the sensor, in accordance with the acceleration of the printing medium acquired by the acceleration acquiring means; and a remaining region control means for controlling a remaining region from a printing position of the print head up to the rear end of the printing medium in accordance with the transportation amount corrected by the correcting means.

Another printing apparatus of the present invention is a printing apparatus for printing an image on a printing medium using a print head, comprising: a transporting means for transporting the printing medium in a predetermined direction; a printing medium detecting means including a detection lever that is provided upstream of the print head in the predetermined direction and that mechanically operates when a rear end of the printing medium passes therethrough and a sensor for detecting the mechanical operation of the detection lever; a table for controlling the transporting means, the table providing a plurality of relationships between a target velocity of the printing medium transported by the transporting means and a correction amount for the rear end of the printing medium; a storage means for storing the table for controlling the transporting means; a velocity acquiring means for acquiring a velocity of the printing medium when the rear end of the printing medium passes through the detection lever; and a remaining region control means reading out the correction amount for the rear end of the printing medium corresponding to the velocity acquired by the velocity acquiring means from the table and controlling a remaining region from a printing position of the print head up to the rear end of the printing medium, in accordance with the correction amount read out from the table.

A method of the present invention is a method for printing an image by ejecting ink from a print head onto a printing medium transported in a predetermined direction by a transporting means, the method comprising the steps of: (a) providing a detection lever that mechanically operates when a rear end of the printing medium passes therethrough and a sensor for detecting the mechanical operation of the detection lever on upstream of the print head in the predetermined direction; (b) acquiring an acceleration of the printing medium when the rear end of the printing medium passes through the detection lever; (c) correcting a transportation amount of the printing medium during a physical return time after the rear end of the printing medium passes through the detection lever until the detection lever is detected by the sensor, in accordance with the acceleration of the printing medium acquired in the step (b); and (d) controlling a remaining region from a printing position of the print head up to the rear end of the printing medium in accordance with the transportation amount corrected in the step (c).

Another method of the present invention is a method for printing an image by ejecting ink from a print head onto a printing medium transported in a predetermined direction by a transporting means, the method comprising the steps of: (a) providing a detection lever that mechanically operates when a rear end of the printing medium passes therethrough and a sensor for detecting the mechanical operation of the lever on upstream side of the print head in the predetermined direction; (b) storing a table for controlling the transporting means in a storage unit, the table providing a plurality of relationships between a target velocity of the printing medium transported by the transporting means and a correction amount for the rear end of the printing medium; (c) acquiring a velocity of the printing medium when the rear end of the printing medium passes through the detection lever; and (d) reading out the correction amount for the rear end of the printing medium corresponding to the velocity acquired in the step (c) from the table and controlling a remaining region from a printing position of the print head up to the rear end of the printing medium, in accordance with the correction amount read out from the table.

The present invention makes it possible to control the remaining region from the printing position of the print head up to the rear end of the printing medium more properly thereby improving an accuracy of printing and an image quality.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
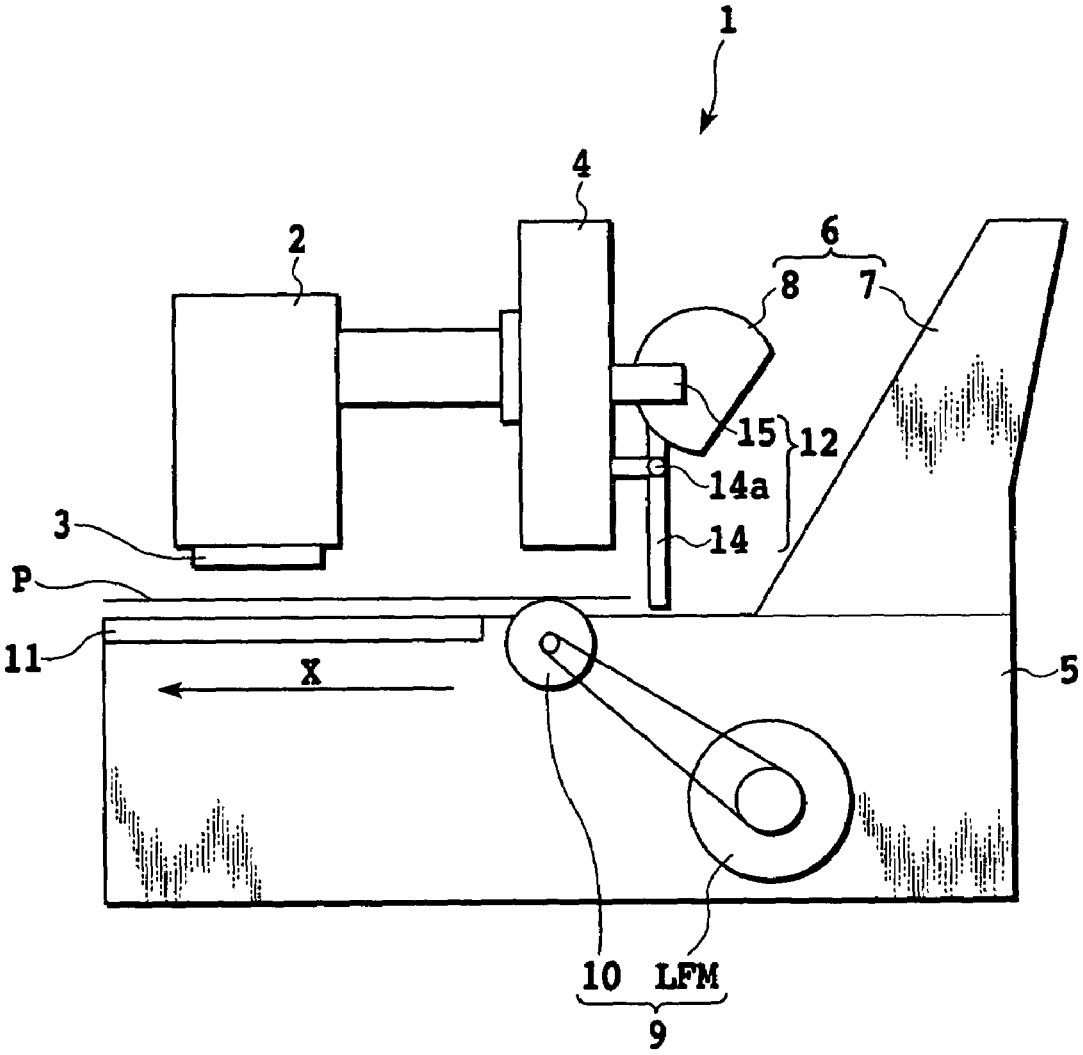
FIG. 1 is a schematic diagram of a first embodiment of a printing apparatus according to the present invention.

In a printing apparatus according to the present invention, an acceleration acquiring means acquires an acceleration of a printing medium when a rear end of the printing medium passes through a detection lever in order to control a remaining region from a printing position of a print head up to the rear end of the printing medium. In the printing apparatus, a correcting means corrects a transportation amount of the printing medium during a physical return time after the rear end of the printing medium passes through the detection lever until the detection lever is detected by a sensor, in accordance with the acceleration acquired by the acceleration acquiring means. Thus, the transportation amount of the printing medium during the physical return time is accurately determined according to the transportation velocity of the printing medium during printing an image. The corrected transportation amount is used to control the remaining region from the printing position of the print head up to the rear end of the printing medium, which provides a good solution to problems such as a positional shift of an image and ejection of ink on to objects other than the printing medium such as a platen. Accordingly, in the printing apparatus, the remaining region from the printing position of the print head up to the rear end of the printing medium can be more properly controlled to improve the accuracy of printing and image quality.

Preferably, a velocity acquiring means acquires a velocity of the printing medium when the rear end of the printing medium passes through the detection lever, and the correcting means determines the transportation amount of the printing medium during the physical return time, in accordance with the acceleration acquired by the acceleration acquiring means and the velocity acquired by the velocity acquiring means.

Preferably, the acceleration acquiring means acquires the acceleration from a previous instruction velocity of to a transporting means for transporting the printing medium and a current instruction velocity to the transporting means, and the velocity acquiring means acquires the current instruction velocity to the transporting means as the velocity of the printing medium.

In another printing apparatus according to the present invention, a table for controlling a transporting means stored in a storage means provides a plurality of relationships between a target velocity of a printing medium transported by the transporting means and a correction amount for a rear end of the printing medium determined so as to correspond to the target velocity. The correction amount for the rear end of the printing medium corresponds to the transportation amount of the printing medium during a physical return time after the rear end of the printing medium passes through the detection lever until the detection lever is detected by a sensor. In the printing apparatus, a velocity of the printing medium acquiring means acquires a velocity when the rear end of the printing medium passes through a detection lever in order to control a remaining region from a printing position of a print head up to the rear end of the printing medium. Further, in the printing apparatus, a correction amount for the rear end of the printing medium corresponding to the velocity acquired by the velocity acquiring means is read out from the table for controlling the transporting means, and the remaining region from the printing position of the print head up to the rear end of the printing medium is controlled in accordance with the correction amount for the rear end of the printing medium read out from the table.

Thus, it is possible to accurately determine the transportation amount of the printing medium during the physical return time corresponding to the transportation velocity of the printing medium during printing an image, by properly setting the plurality of relationships between the target transportation velocity and the correction amount corresponding thereto in table for controlling the transporting means. The remaining region from the printing position of the print head up to the rear end of the printing medium can be controlled using the correction amount for the rear end of the printing medium, which provides a good solution for problems such as a positional shift of an image and ejection of ink on to objects other than the printing medium such as a platen. The printing apparatus can therefore achieve printing with improved accuracy and image quality through more proper control over a remaining region from the printing position of the print head up to the rear end of the printing medium.

Preferred embodiments of a printing apparatus and a method for printing an image according to the present invention will now be described in detail with reference to the drawings.

[First Embodiment]

FIG. 1 is a schematic diagram of a printing apparatus according to the present invention. A printing apparatus 1 shown in FIG. 1 is a serial inkjet printer. The printing apparatus 1 includes a carriage 2 and a print head 3 capable of ejecting ink. The print head 3 is mounted on the carriage 2 and the carriage 2 can be reciprocated in a main scanning direction extending through the plane of the drawing by a carriage driving mechanism 4 including a carriage motor CRM.

The print head 3 is a so-called inkjet head and includes a plurality of electrothermal transducers for converting electrical energy into thermal energy. Film boiling of ink is caused in the print head 3 by the thermal energy generated by the electrothermal transducers, and ink is ejected from each of nozzles utilizing a pressure change that is caused by growth and contraction of bubbles attributable to the film boiling. An electrothermal transducer is provided in each of the nozzles, and a pulse voltage is applied to each of the electrothermal transducers to eject ink.

A feeding mechanism 6 is disposed on a rear portion of a base 5 of the printing apparatus 1. The feeding mechanism 6 includes a feed tray 7 and a feed roller 8. Print media (paper) P are placed on the feed tray 7 of the feeding mechanism 6. The feed roller 8 is driven by a feed motor ASFM (that is omitted in FIG. 1) and the printing medium P is sent out from the feed tray 7 by the feed roller 8. A transporting mechanism (transporting means) 9 is disposed on the base 5. The transporting mechanism 9 includes a feed roller 10 that is driven by a transport motor LFM. The printing medium P from the feed tray 7 is transported by the transporting mechanism 9 in the direction of the arrow X in FIG. 1 (a transporting direction) to a printing medium outlet tray (not shown) via a printing position opposite to the print head 3. A platen 11 for positioning the printing medium P during printing an image is disposed below the print head 3.

The printing apparatus 1 further includes a printing medium detecting unit 12 that is disposed upstream of the print head 3 in the transporting direction X for detecting a rear end of the printing medium P. The printing medium detecting unit 12 includes a swing-type detection lever 14 and an optical sensor 15 for detecting the operation of the detection lever 14.

Figure 2A:
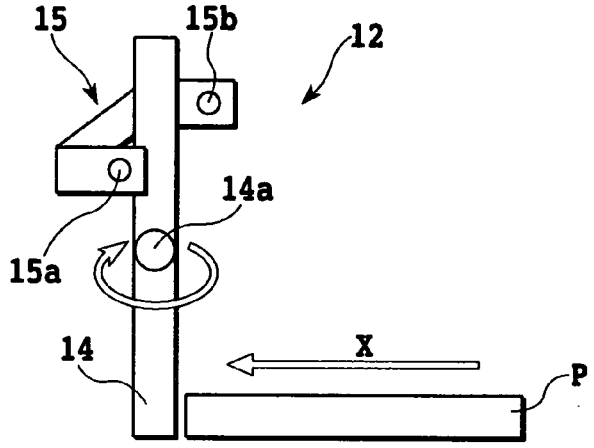
FIGS. 2A, 2B, and 2C are schematic illustrations for explaining a detecting means included in the printing apparatus of FIG. 1.
Figure 2B:
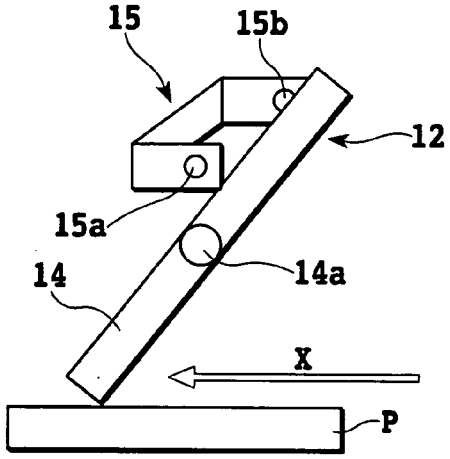
Figure 2C:
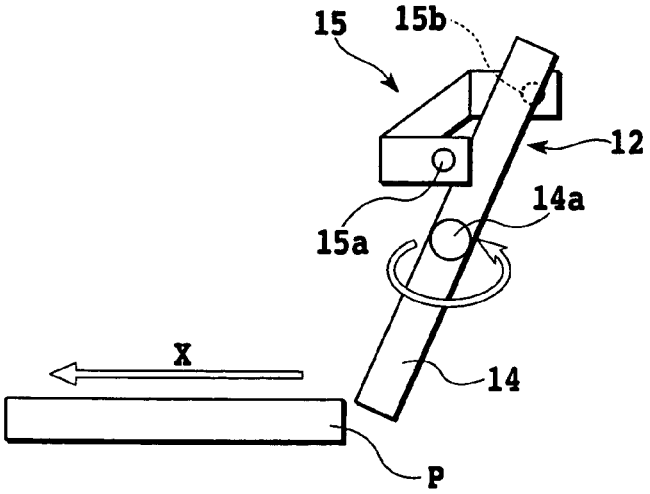

The detection lever 14 can swing about a rotating shaft 14*a* disposed near the center in the longitudinal direction thereof. The detection lever 14 is urged by a spring (not shown) so as to stay in a standby position in which it substantially vertically extends as shown in FIGS. 1 and 2A when no external force is applied thereto at all. The optical sensor 15 is disposed in the vicinity of the upper end of the detection lever 14 in the figure. The optical sensor 15 has a light-emitting section 15*a* and a light-receiving section 15*b* as shown in FIGS. 2A to 2C. When the detection lever 14 is in the standby position described above, an optical path between the light-emitting section 15*a* and the light-receiving section 15*b* is blocked by the detection lever 14.

The operation of the printing medium detecting unit 12 will be described in detail with reference to FIGS. 2A to 2C. When the printing medium P sent out by the feeding mechanism 6 contacts an end (a lower end) of the detection lever 14 in the standby position, the detection lever 14 starts to swing clockwise in the figure against the urging force of the spring, as shown in FIG. 2B. This removes the blockade of the optical path between the light-emitting section 15*a* and the light-receiving section 15*b* by the detection lever 14, and the optical sensor 15 outputs a signal indicating that the printing medium P has been detected (a signal indicating the presence of the printing medium P).

Thereafter, the printing medium P reaches the printing position of the print head 3, and the print head 3 starts printing an image on the printing medium P. As shown in FIG. 2B, the detection lever 14 keeps rotating clockwise in the figure while the printing medium P is in contact with the detection lever 14. When the rear end of the printing medium P completely passes through the detection lever 14 as shown in FIG. 2C, the detection lever 14 is returned to the standby position in FIG. 2A by the urging force of the spring. When the detection lever 14 returns to the standby position, the optical path between the light-emitting section 15*a* and the light-receiving section 15*b* is blocked by the detection lever 14 again, and the optical sensor 15 outputs a signal indicating that the rear end of the printing medium P has been detected (a rear end detection signal) at this stage.

Figure 3:
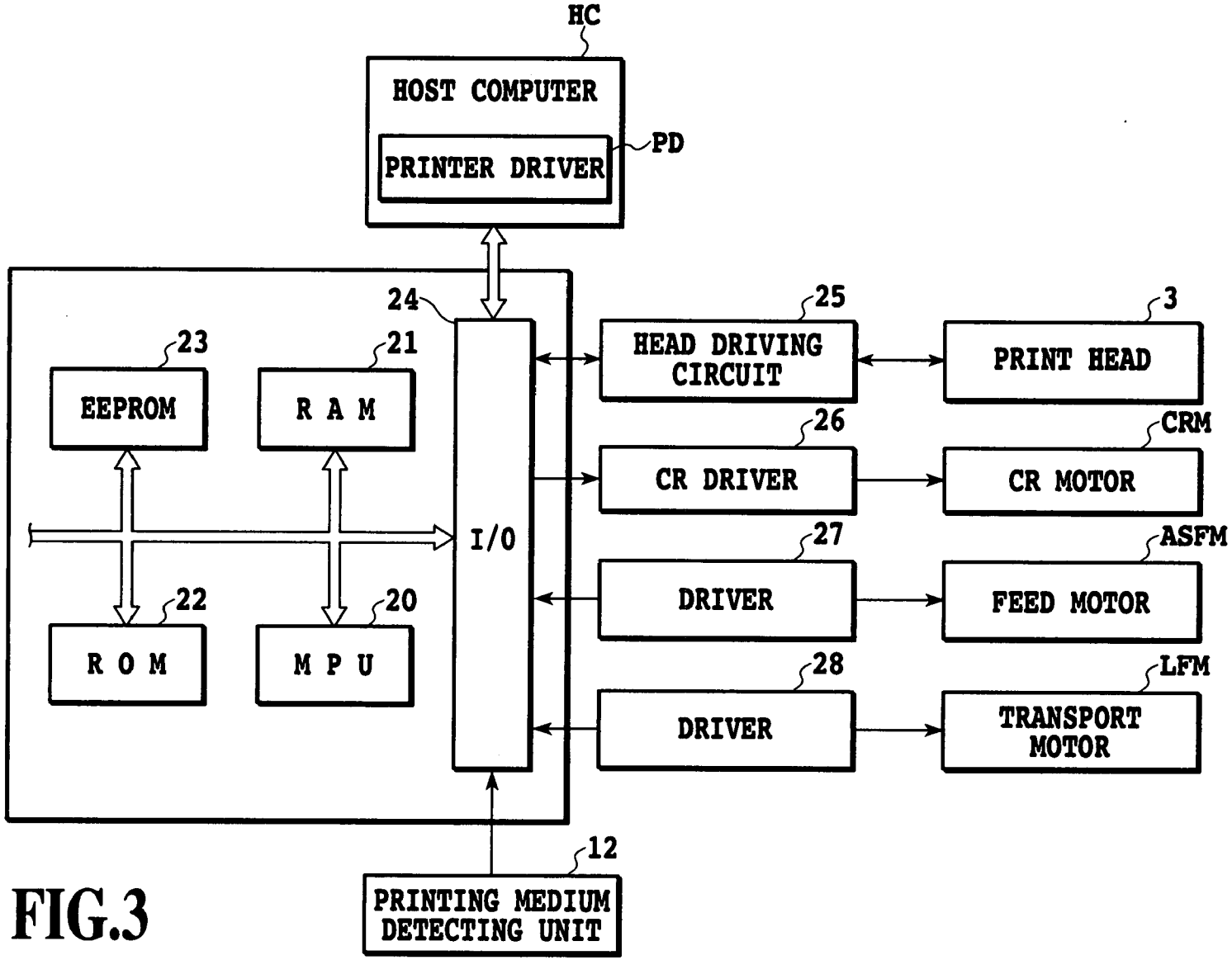
FIG. 3 is a block diagram of the printing apparatus shown in FIG. 1.

FIG. 3 is a block diagram of the printing apparatus 1 of the present embodiment. As shown in FIG. 3, the printing apparatus 1 includes a MPU 20 that serves as a means for controlling the apparatus as a whole. A RAM 21, a ROM 22, and a memory 23 are connected to the MPU 20 through a bus line. The RAM 21 includes a receiving buffer for temporarily holding various data, a print buffer, and a work RAM used as a work area for arithmetic processes associated with various kinds of control. Programs for various kinds of control are stored in the ROM 22. Various tables used for controlling the printing apparatus 1 are stored in the memory 23.

Further, an I/O interface 24 is connected to the MPU 20 through the bus line, and an external host computer HC is connected to the I/O interface 24. The print head 3 is connected to the I/O interface 24 through a head driving circuit 25 and controlled by the MPU 20. Similarly, the carriage motor CRM of the carriage driving mechanism 4 and the feed motor ASFM are connected to the I/O interface 24 through a CR driver 26 or a driver 27, respectively. Similarly, the transport motor LFM of the transporting mechanism 9 is connected to the I/O interface 24 through a driver 28. Further, the optical sensor 15 and other switches of the printing medium detecting unit 12 are connected to the I/O interface 24.

Figure 4:
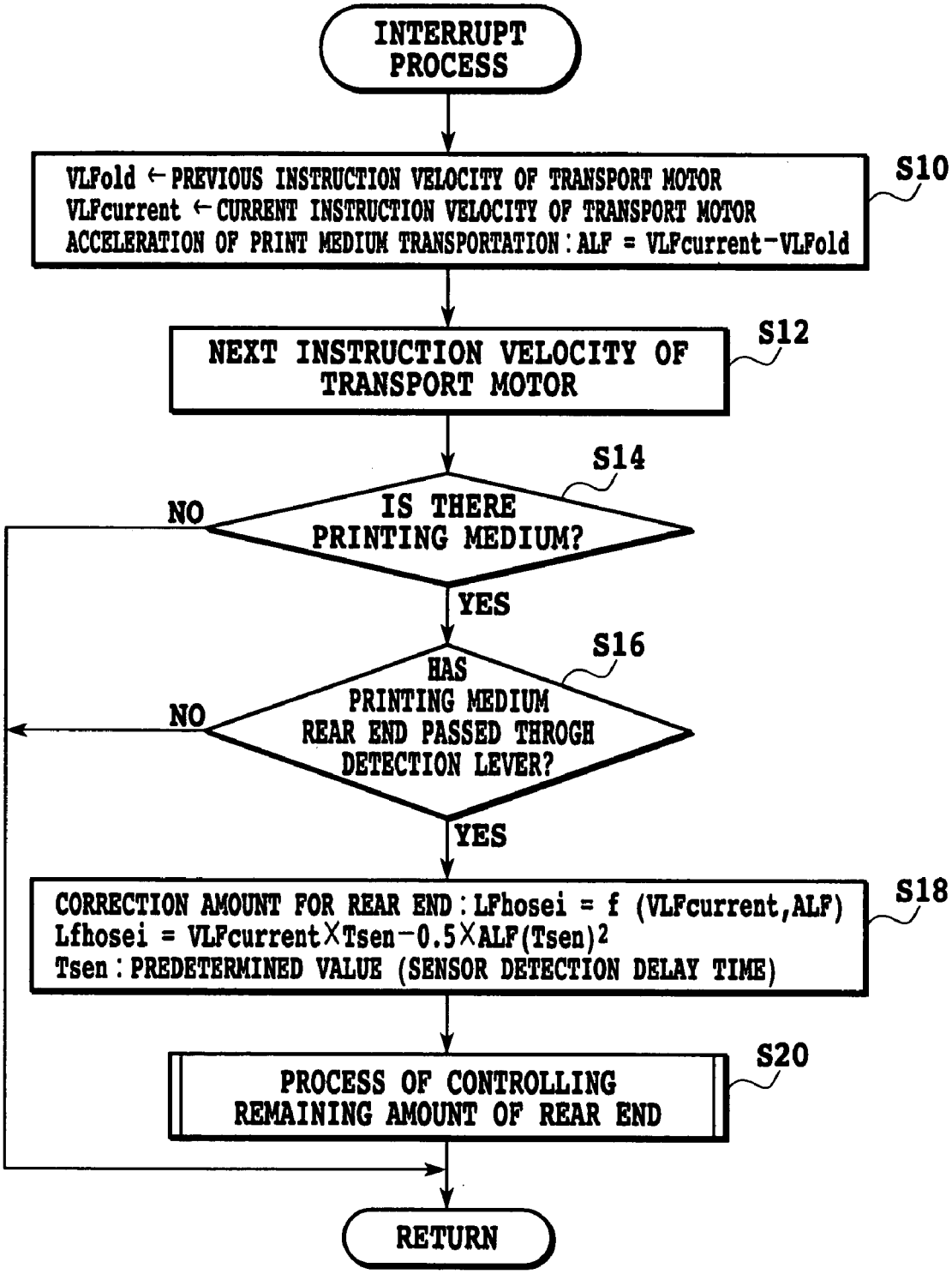
FIG. 4 is a flow chart for explaining an operation of the printing apparatus in FIG. 1.

A description will now be made with reference to FIGS. 4 and 5 on a process of controlling a region remaining at the rear end of the printing medium performed in the printing apparatus 1 of the present embodiment. The remaining region control process is performed as an interrupt process to change the transportation velocity of the printing medium P by the transporting mechanism 9 (the rotational velocity of transport motor LFM) during a series of printing operations of the printing apparatus 1.

First, when the host computer HC (printer driver) instructs the MPU 20 of the printing apparatus 1 to change the transportation velocity of the printing medium P by the transporting mechanism 9 (the velocity of rotation of the transport motor LFM), the MPU 20 temporarily stores a current instruction velocity "VLFcurrent" of the transport motor LFM and a previous instruction velocity "VLFold" of the transport motor LFM in the work area of the RAM 21 (step S10). The current instruction velocity of the transport motor LFM is a rotational velocity of the transport motor LFM at the point in time when the interrupt process is instructed, and the previous instruction velocity of the transport motor LFM is a rotational velocity of the transport motor LFM corresponding to the instruction preceding the current instructed velocity.

In step S10, the MPU 20 further calculates ALF= VLFcurrent−VLFold to identify an acceleration "ALF" at which the rotational velocity of the transport motor LFM reaches the current instruction velocity "VLFcurrent" from the previous instruction velocity "VLFold." Then, the MPU 20 reads out a new instruction velocity "VLFnew" for the transport motor LFM to be set at the current interrupt process from a table for driving the transport motor LFM stored in the memory 23 and provides the driver 28 with an instruction to set the rotational velocity of the transport motor LFM at the new instructed velocity "VLFnew" (step S12).

After the process of step S12, the MPU 20 determines whether a signal indicating the detection of the printing medium P (signal indicating the presence of the printing medium P) has been received from the sensor 15 of the printing medium detecting unit 12 (step S14). When it is determined in step S14 that the signal indicating the presence of the printing medium P has been received, the MPU 20 further determines whether a signal indicating the detection of the rear end of the printing medium P (rear end detection signal) has been received from the sensor 15 (step S16). When it is determined that the rear end detection signal has been received from the sensor 15, the MPU 20 performs a correcting process in step S18.

The correcting process of step S18 is a process for correcting (calculating) a transportation amount of the printing medium P during a physical return time (a sensor detection delay time) "Tsen" after the rear end of the printing medium P passes through the detection lever 14 (or after it leaves the lever 14) until the lever 14 is detected by the sensor 15. The physical return time "Tsen" is a constant value that is determined by the spring constant of the spring for urging the detection lever 14.

Figure 5:
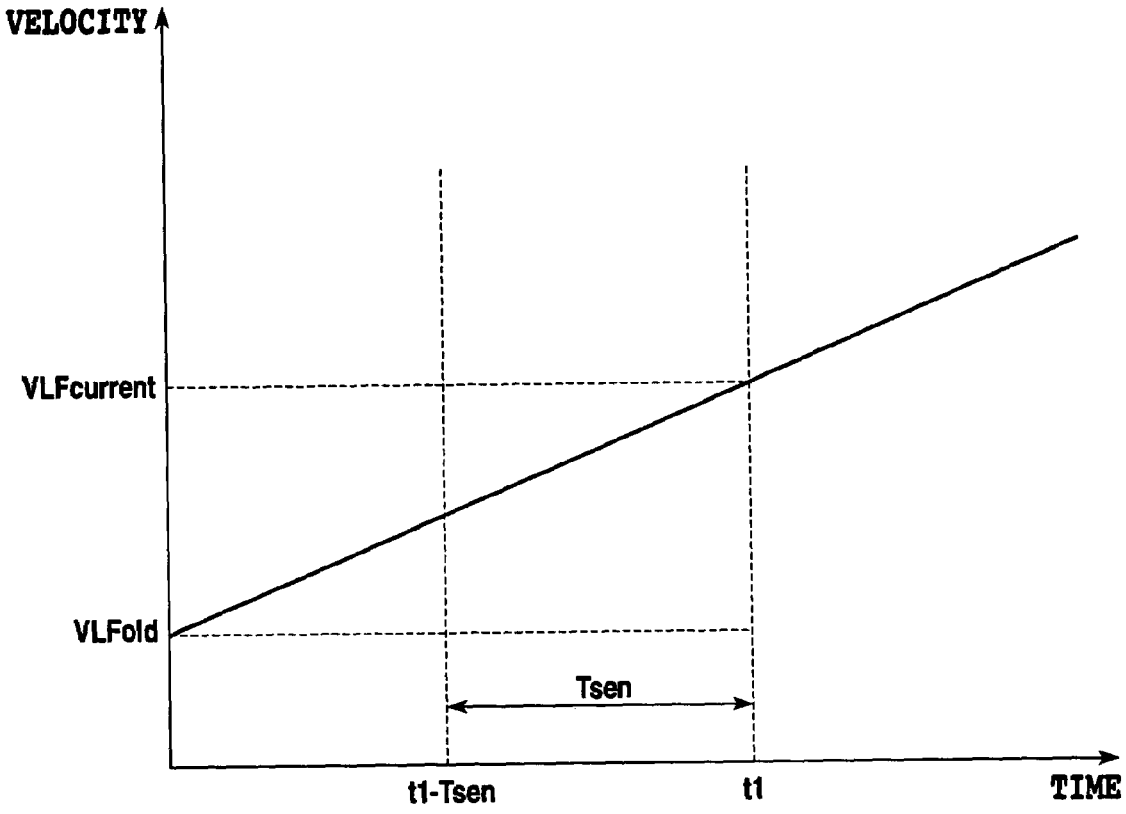
FIG. 5 is a graph for explaining a transportation amount of a printing medium during a physical return time after a rear end of the printing medium passes through a detection lever until the detection lever is detected by a sensor.

Assuming that the MPU 20 receives the rear end detection signal from the sensor 15 at a point in time "t1" as shown in FIG. 5, the rear end of the printing medium P has passed through the detection lever 14 (i.e., it has left the detection lever 14) at time "t1—Tsen (at time "Tsen" before the time "t1"). The current instruction velocity "VLFcurrent" of the transport motor LFM stored at step S10 and the printing medium acceleration "ALF" correspond to the velocity and acceleration of the transport motor LFM (the transportation velocity and acceleration of the printing medium P) at the point in time when the rear end of the printing medium P passes through the detection lever 14.

Therefore, a correction amount for the rear end of the paper "LFcorrect" that is the transportation amount of the printing medium P during the physical return time "Tsen" can be calculated as shown below by performing an integration process on the transportation velocity of the printing medium P and the acceleration of the printing medium P, as seen from FIG. 5.

$$LF\text{corresct}=VLF\text{current}\times T\text{sen}-0.5\times ALF\times(T\text{sen})^2 \quad (1)$$

The MPU 20 determines the correction amount "LFcorrect" for the rear end of the printing medium P in accordance with the Equation (1) in step S18.

After determining the correction amount "LFcorrect" for the rear end of the printing medium P in step S18, the MPU 20 performs a process for controlling a remaining amount of the rear end portion of the printing medium P (S20). In step S20, the correction amount "LFcorrect" for the rear end of the printing medium P is subtracted from a reference length of a remaining region stored in advance to determine the remaining region at the point in time when the rear end detection signal is output by the sensor 15 (a region of the printing medium P on which an image can be printed by the print head 3 at and after the point in time when the rear end detection signal is output by the sensor 15). Then, predetermined control is performed on the transporting mechanism 9 (transport motor LFM) in accordance with the value of the remaining region thus determined.

When it is determined in step S14 that no signal indicating the presence of the printing medium P is output by the sensor 15 and when it is determined in step S16 that no rear end detection signal is output by the sensor 15, the correction process in step S18 is not performed. That is, only the process of changing the velocity of the transport motor LFM (step S12) is performed in those cases.

As has been described above, in the printing apparatus 1, when the instruction is provided with the MPU 20 to change the transportation velocity of the printing medium P transported by the transporting mechanism 9 (the rotational velocity of the transport motor LFM), the velocity "VLFcurrent" and acceleration "ALF" of printing medium P at the time when the rear end of the printing medium P passes through the detection lever 14 are acquired (step S10). The printing apparatus 1 then determines the transportation amount of the printing medium P during the physical return time "Tsen," i.e., a correction amount "LFcorrect" for the rear end of the printing medium P in accordance with the velocity "VLFcurrent" and the acceleration "ALF."

As a result, the transportation amount of the printing medium P during the physical return time "Tsen" can be accurately determined in accordance with the transportation velocity of the printing medium P during printing an image. The transporting amount thus corrected is used to control the remaining region from the printing position of the print head 3 up to the rear end of the printing medium P, which provides a good solution to problems such as a positional shift of an image and ejection of ink on to objects other than the printing medium P such as the platen 11. Therefore, in the printing apparatus 1, the remaining region from the printing position of the print head 3 up to the rear end of the printing medium P can be more properly controlled to improve the accuracy of printing and image quality.

[Second Embodiment]

A second embodiment of the invention will now be described with reference to FIGS. 6 to 8. The same elements as those described with reference to the first embodiment are referred to same reference numerals and same description will be omitted.

In the above-described first embodiment, the velocity of the printing medium P "VLFcurrent" and the printing medium transport acceleration "ALF" at the time when the rear end of the printing medium P passes through the detection lever 14 are acquired, and the transportation amount of the printing medium P during the physical return time "Tsen" after the rear end of the printing medium P passes through the detection lever 14 until the lever 14 is detected by a sensor 15, i.e., the correction amount "LFcorrect" for the paper rear end is directly determined.

On the other hand, in the present embodiment, a table for controlling the transport motor LFM is stored in a memory 23 so as to provide a plurality of relationships between a target velocity (instruction velocity) of the transportation of the printing medium P by a transporting mechanism 9 and a correction amount for the rear end of the printing medium P determined so as to correspond to the target transportation velocity of the printing medium P (transportation amount of the printing medium P during a physical return time "Tsen").

Figure 6:
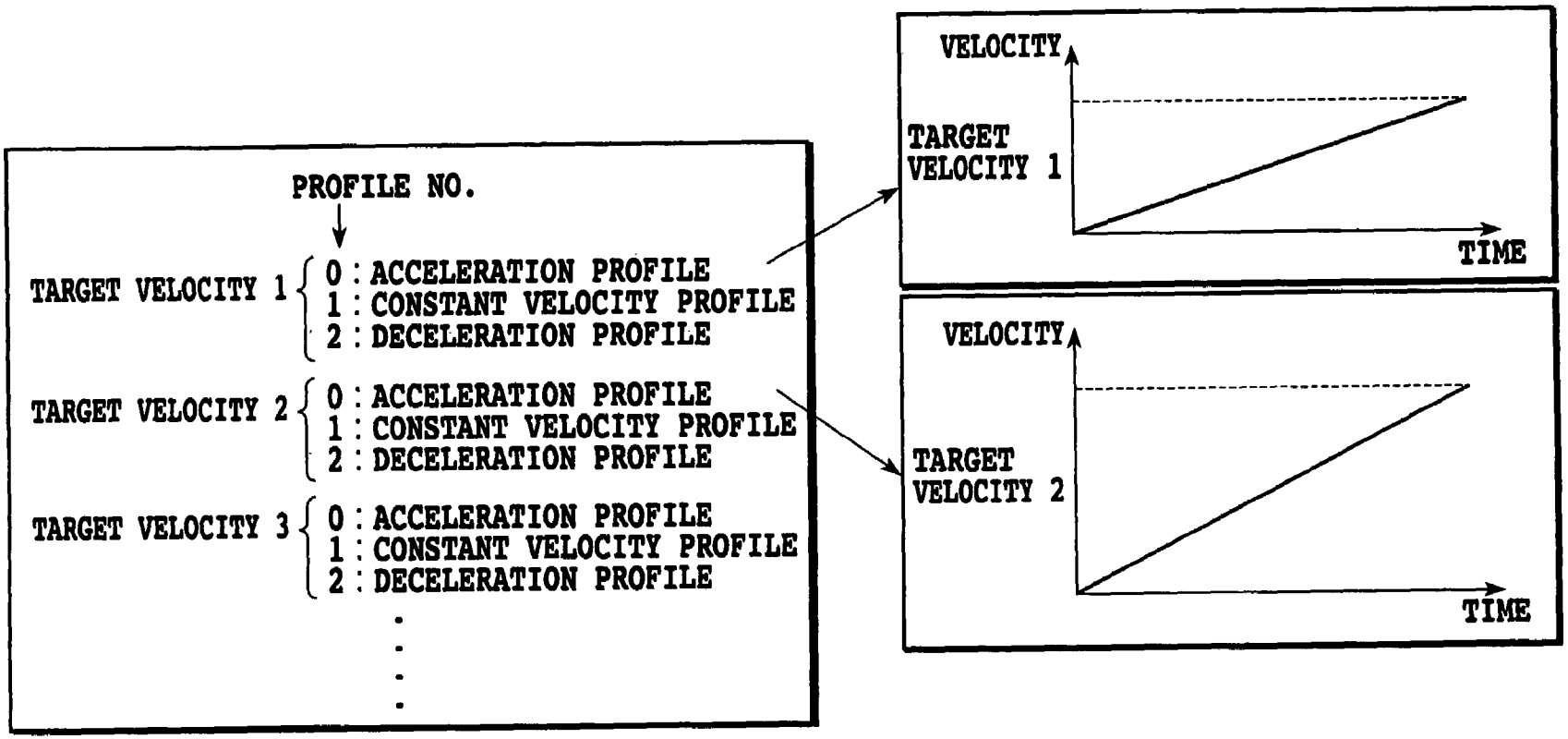
FIG. 6 is a schematic illustration for explaining a table for controlling a transporting mechanism of a second embodiment of the printing apparatus according to the present invention.

More specifically, as seen from FIG. 6, the table for controlling the transport motor LFM includes a plurality of transportation velocities (instruction velocities) of the printing medium P, i.e., a target transportation velocity 1, a target transportation velocity 2, a target transportation velocity 3 and so on that are required for the transportation mechanism 9 (a transport motor LFM) according to operations of the printing apparatus 1. Further, the table for controlling the transport motor LFM includes driving profiles that are created in advance for each of the target transportation velocities and that define accelerating conditions for the transport motor LFM. In the present embodiment, three types of driving profiles, i.e., driving profiles for acceleration, a constant velocity (at which acceleration is 0) and deceleration are prepared for each of the target transportation velocities 1, 2, 3 and so on.

A profile number TblLFNo is assigned to each of the driving profiles. That is, the profile number TblLFNo of a driving profile for acceleration is "0"; the profile number TblLFNo of a driving profile for a constant velocity is "1"; and the profile number TblLFNo of a driving profile for deceleration is "2". The acceleration in the profiles for acceleration and deceleration is determined in advance in accordance with the respective target transportation velocities so as to correspond to operations required for the printing apparatus 1.

Figure 7:
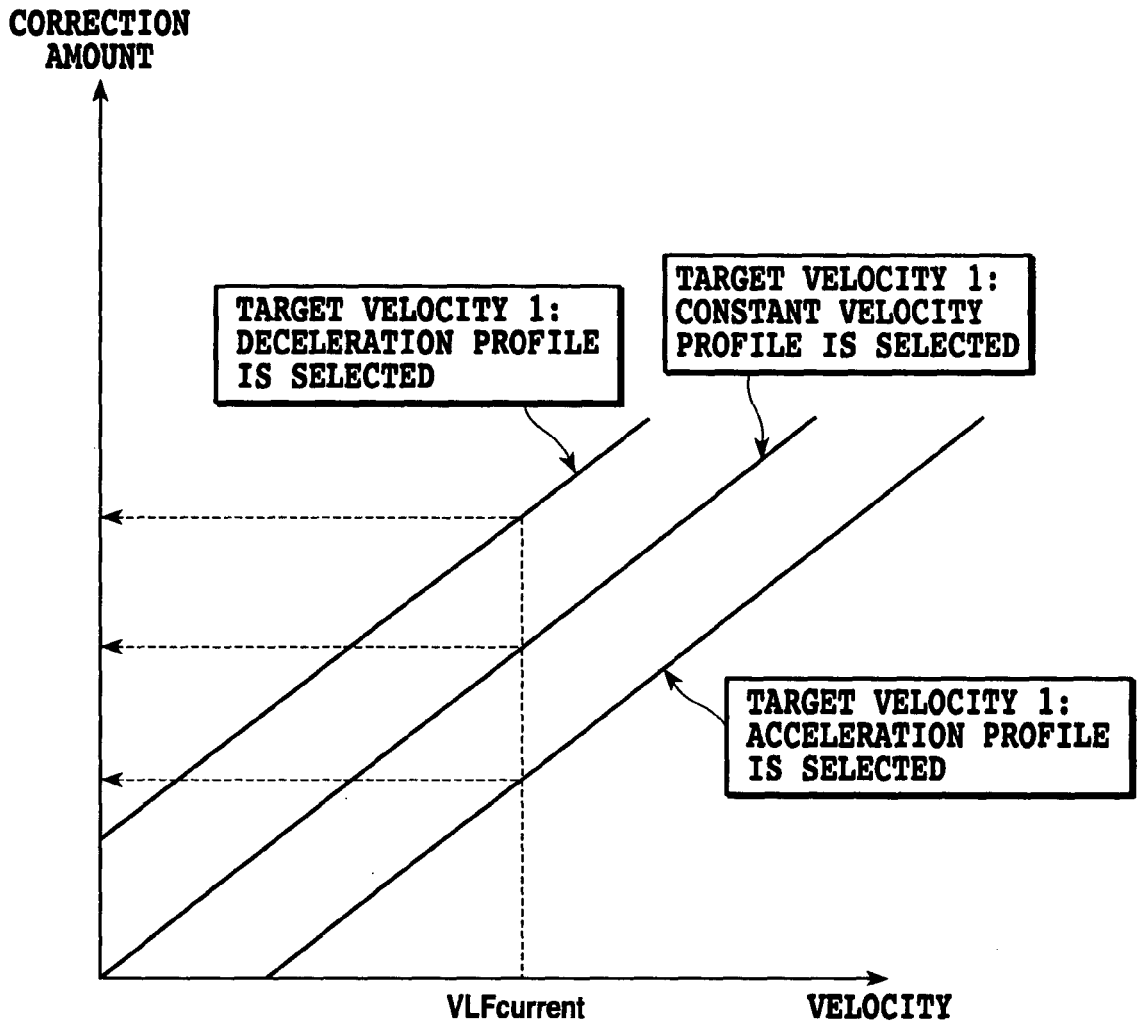
FIG. 7 is a graph showing relationships between a target transportation velocity of the print medium and a correction amount for the rear end of the printing medium.
Figure 8:
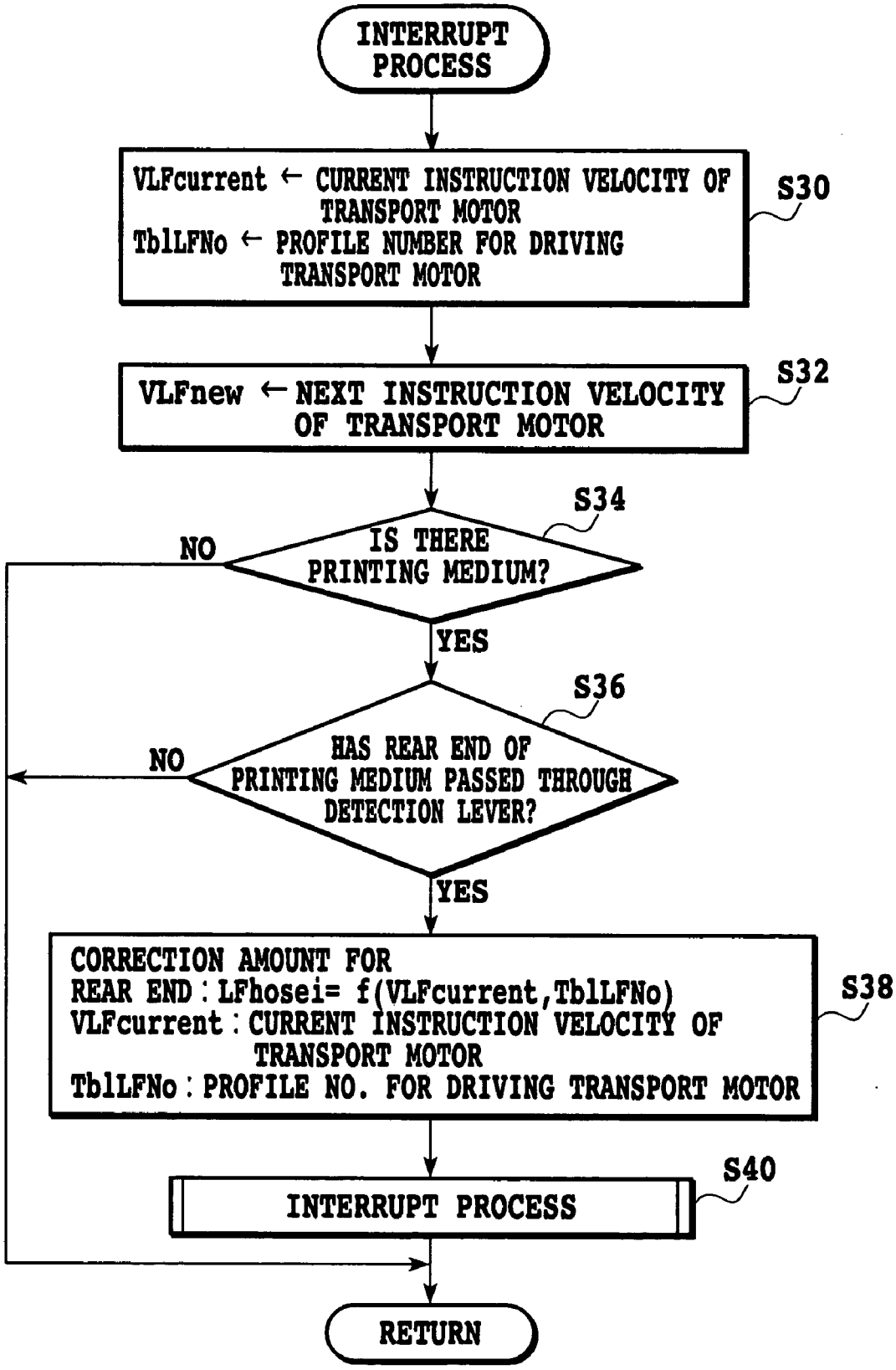
FIG. 8 is a flow chart for explaining an operation of the second embodiment of the printing apparatus according to the present invention.

As seen from FIG. 7, the table for controlling the transport motor LFM includes target transportation velocities of the transport motor LFM and values of correction amounts "LFcorrect" for the rear end of the printing medium P or functional equations for determining the correction amounts "LFcorrect," the values or equations being determined in accordance with the respective driving profiles associated with the target transportation velocities. In the present embodiment, a target transportation velocity for the transport motor LFM and a driving profile at the same target transportation velocity are specified, and the correction amount "LFcorrect" for the rear end of the printing medium P corresponding to the specified conditions can be picked up from the table for controlling the transport motor LFM. In the table for controlling the transport motor LFM, the values of the correction amounts "LFcorrect" or the functional equations for determining the same are different depending on the target transportation velocities and the driving profiles. For example, Equation 1 may be used as a functional equation for determining the correction amount "LFcorrect".

A description will now be made with reference to FIG. 8 on a process of controlling a remaining region of the rear end of the printing medium in the printing apparatus according to the present embodiment utilizing the table for controlling the transport motor.

First, when a host computer HC (printer driver) instructs an MPU 20 of a printing apparatus 1 to change the transportation velocity of the printing medium P by the transporting mechanism 9 (the rotational velocity of the transport motor LFM), the MPU 20 temporarily stores a current instruction velocity of the transport motor LFM, i.e., the velocity "VLFcurrent" of the transport motor LFM at the time when the rear end of the printing medium P passes through the detection lever 14 and a profile number "TblLFNo" used at the current velocity "VLFcurrent" in the work area of a RAM 21 (step S30).

The MPU 20 then reads out a target transportation velocity and a driving profile that correspond to the new instruction velocity "VLFnew" and a profile number "TblLFNo" being set at the current interrupt process from the table for controlling the transport motor LFM. Further, the MPU 20 provides the driver 28 with a predetermined instruction so that the rotational velocity of the transport motor LFM reaches the target transportation velocity in accordance with the read-out driving profile (step S32).

After performing the process of step S32, the MPU 20 further determines whether a signal indicating the detection of the printing medium P (a signal indicating the presence of the printing medium P) has been received from the sensor 15 of the printing medium detecting unit 12 (step S34). When it is determined in step S34 that a signal indicating the presence of the printing medium P has been received from the sensor 15, the MPU 20 further determines whether a signal indicating the detection of the rear end of the printing medium P (rear end detection signal) has been received from the sensor 15 (step S36). When it is determined that the rear end detection signal has been received from the sensor 15, the MPU 20 performs a process of step S38.

In step S38, the MPU 20 selects a target transportation velocity of and a driving profile that correspond to the current instruction velocity "VLFcurrent" of the transport motor LFM and the profile number "TblLFNo" read in step S30 and reads out a correction amount "LFcorrect" corresponding to them. When the correction amount "LFcorrect" is acquired in step S38, the MPU 20 performs a process of controlling the remaining amount of the rear end portion of the printing medium P in accordance with procedures similar to those at step S20 in the first embodiment described above (step S40). When it is determined in step S34 that no signal indicating the presence of the printing medium P is output by the sensor 15 and when it is determined in step S36 that no rear end detection signal is output by the sensor 15, the correcting process of step S38 is not performed. Only the process of changing the velocity of the transport motor LFM (step S32) is performed in those cases.

As has been described above, in the present embodiment, when the instruction is given to change the transportation velocity of the printing medium P by the transporting mechanism 9 (the rotational velocity of the transport motor LFM), the velocity "VLFcurrent" of the printing medium P at the time when the rear end of the printing medium P passes through the detection lever 14 is acquired.

In the present embodiment, the correction amount "LFcorrect" for the rear end of the printing medium P corresponding to the acquired velocity "VLFcurrent" is read from the table for controlling the transport motor, and the remaining region from the printing position of the print head 3 up to the rear end of the printing medium P is controlled in accordance with the read-out correction amount "LFcorrect."

Accordingly, the transportation amount of the printing medium P during the physical return time "Tsen" can be accurately determined in accordance with the transportation velocity of the printing medium P by appropriately setting a plurality of relationships between the target transportation velocity and the correction amount "LFcorrect" corresponding thereto in the table for controlling the transport motor LFM. The transportation amount thus corrected is used to control the remaining region from the printing position of the print head 3 up to the rear end of the printing medium P, which provides a good solution to problems such as a positional shift of an image and ejection of ink on to objects other than the printing medium P such as a platen. Therefore, the present embodiment also allows a remaining region of printing medium P from the printing position of the print head 3 up to a rear end of the same to be more properly controlled to improve the accuracy of printing and image quality.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus for printing an image on a printing medium using a print head, comprising:

a transporting means for transporting said printing medium in a predetermined direction;

a printing medium detecting means including a detection lever that is provided upstream of said print head in said predetermined direction and that mechanically operates when a rear end of said printing medium passes therethrough and a sensor for detecting the mechanical operation of said detection lever;

an acceleration acquiring means for acquiring an acceleration of said printing medium when said rear end of said printing medium passes through said detection lever; and a correcting means for correcting a transportation amount of said printing medium during a physical return time after said rear end of said printing medium passes through said detection lever until said detection lever is detected by said sensor, in accordance with said acceleration of said printing medium acquired by said acceleration acquiring means; and a remaining region control means for controlling a remaining region from a printing position of the print head up to said rear end of said printing medium in accordance with said transportation amount corrected by said correcting means.

2. A printing apparatus according to claim 1, further comprising a velocity acquiring means for acquiring a velocity of said printing medium when said rear end of said printing medium passes through said detection lever, and wherein said correcting means determines said transportation amount of said printing medium during said physical return time, in accordance with said acceleration acquired by said acceleration acquiring means and said velocity acquired by said velocity acquiring means.

3. A printing apparatus according to claim 2, wherein said acceleration acquiring means acquires said acceleration from a previous instruction velocity to said transporting means and a current instruction velocity to said transporting means and wherein said velocity acquiring means acquires said current instruction velocity as said velocity of said printing medium.

4. A printing apparatus for printing an image on a printing medium using a print head, comprising:

a transporting means for transporting said printing medium in a predetermined direction;

a printing medium detecting means including a detection lever that is provided upstream of said print head in said predetermined direction and that mechanically operates when a rear end of said printing medium passes therethrough and a sensor for detecting the mechanical operation of said detection lever;

a table for controlling said transporting means, said table providing a plurality of relationships between a target velocity of said printing medium transported by said transporting means and a correction amount for said rear end of said printing medium;

a storage means for storing said table for controlling said transporting means;

a velocity acquiring means for acquiring a velocity of said printing medium when said rear end of said printing medium passes through said detection lever; and a remaining region control means reading out said correction amount for said rear end of said printing medium corresponding to said velocity acquired by said velocity acquiring means from said table and controlling a remaining region from a printing position of said print head up to said rear end of said printing medium, in accordance with said correction amount read out from said table.

5. A printing apparatus according to claim 4, wherein said correction amount for said rear end of said printing medium provided by said table for controlling said transporting means is a transportation amount of said printing medium during a physical return time after said rear end of said printing medium passes through said detection lever until said detection lever is detected by said sensor.

6. A method for printing an image by ejecting ink from a print head onto a printing medium transported in a predetermined direction by a transporting means, said method comprising the steps of:

(a) providing a detection lever that mechanically operates when a rear end of said printing medium passes therethrough and a sensor for detecting the mechanical operation of said detection lever on upstream of said print head in said predetermined direction;

(b) acquiring an acceleration of said printing medium when said rear end of said printing medium passes through said detection lever;

(c) correcting a transportation amount of said printing medium during a physical return time after said rear end of said printing medium passes through said detection lever until said detection lever is detected by said sensor, in accordance with said acceleration of said printing medium acquired in said step (b); and (d) controlling a remaining region from a printing position of said print head up to said rear end of said printing medium in accordance with said transportation amount corrected in said step (c).

7. A method according to claim 6, further comprising a step of:

(b') acquiring a velocity of said printing medium when said rear end of said printing medium passes through said detection lever, and wherein said step (c) includes determining said transportation amount of said printing medium during said physical return time, in accordance with said acceleration acquired in said step (b) and said velocity acquired in said step (b').

8. A method according to claim 7, wherein said step (b) includes acquiring said acceleration from a previous instruction velocity of to said transporting means and a current instruction velocity to said transporting means, and wherein said step (b') includes acquiring said current instruction velocity as said velocity of said printing medium.

9. A method for printing an image by ejecting ink from a print head onto a printing medium transported in a predetermined direction by a transporting means, said method comprising the steps of:

(a) providing a detection lever that mechanically operates when a rear end of said printing medium passes therethrough and a sensor for detecting the mechanical operation of the said lever on upstream side of said print head in said predetermined direction;

(b) storing a table for controlling said transporting means in a storage unit, said table providing a plurality of relationships between a target velocity of said printing medium transported by said transporting means and a correction amount for said rear end of said printing medium;

(c) acquiring a velocity of said printing medium when said rear end of said printing medium passes through said detection lever; and (d) reading out said correction amount for said rear end of said printing medium corresponding to said velocity acquired in said step (c) from said table and controlling a remaining region from a printing position of said print head up to said rear end of said printing medium, in accordance with said correction amount read out from said table.

10. A method according to claim 9, wherein said correction amount for said rear end of said printing medium provided by said table for controlling said transporting means is a transportation amount of said printing medium during a physical return time after said rear end of said printing medium passes through said detection lever until said detection lever is detected by said sensor.

* * * * *